United States Patent [19]

Grantham

[11] Patent Number: 4,463,944

[45] Date of Patent: Aug. 7, 1984

[54] LAUNDRY STACKING APPARATUS

[76] Inventor: Frederick W. Grantham, 12055 Goshen Ave., Los Angeles, Calif. 90049

[21] Appl. No.: 423,672

[22] Filed: Sep. 27, 1982

[51] Int. Cl.[3] ..... B65H 29/50

[52] U.S. Cl. ..... 271/200; 198/422; 198/503; 198/859; 271/69; 271/73; 271/175; 271/202; 271/213; 271/270; 414/47; 414/901

[58] Field of Search ..... 271/200, 199, 175, 213, 271/176, 202, 270, 198, 67, 69, 73; 198/422, 859, 503; 414/43, 47, 80, 91, 901; 38/143

[56] References Cited

U.S. PATENT DOCUMENTS

| | | | |
|---|---|---|---|
| 25,524 | 9/1859 | Potter et al. | 271/200 |
| 2,250,572 | 7/1941 | Cumfer | 271/200 X |
| 2,330,903 | 10/1943 | McDearmid | 271/175 X |
| 2,686,673 | 8/1954 | Morgan | 271/175 |
| 2,737,390 | 3/1956 | Morgan et al. | 271/175 |
| 2,743,924 | 5/1956 | Elliott et al. | 271/175 |
| 2,766,045 | 10/1956 | Morgan et al. | 271/175 |
| 2,855,089 | 10/1958 | Griffin | 271/175 X |
| 3,051,332 | 8/1962 | Richert et al. | 271/202 X |
| 3,945,635 | 3/1976 | Marin | 271/202 |
| 3,986,598 | 10/1976 | Grantham | 198/503 X |
| 4,034,846 | 7/1977 | Burgis et al. | 271/213 X |
| 4,042,124 | 8/1977 | Bowdry et al. | 198/859 X |

*Primary Examiner*—Bruce H. Stoner, Jr.

*Assistant Examiner*—John A. Carroll

*Attorney, Agent, or Firm*—Henry M. Bissell

[57] ABSTRACT

A laundry piece stacking device which stacks a predetermined number of laundry pieces uniformly and evenly in a stack. Laundry pieces of a predetermined size are conveyed from an ironing area along a double feed conveyor to a swing arm conveyor. The swing arm conveyor is pivotable and rotates in an arc above a work discharge zone. By appropriate adjusting elements, the laundry pieces are evenly draped over a first conveyor in a stacking arrangement until the number of pieces in the stack equals a predetermined count. At that time, the first conveyor and a second, adjacent conveyor are activated for a brief interval so that the first stack formed is transported away from the work deposit zone towards a workpiece receiving area located at the far end of the second conveyor means. The swing arm conveyor is inhibited from operation during this time period. After one stack is removed, additional stacks are formed on the first conveyor and sequentially conveyed towards the receiving area. The number of stacks formed at one time on the first and second conveyors is dependent upon the laundry piece size and the length of the first and second conveyors. Counters are provided for indicating the number of laundry pieces in the stack currently being formed and the total number of laundry pieces stacked.

12 Claims, 5 Drawing Figures

LAUNDRY STACKING APPARATUS

BACKGROUND OF THE INVENTION

1. Field of the Invention

This invention relates to apparatus for stacking material and, more particularly, to apparatus for stacking laundry pieces into a stack by count.

2. Description of the Prior Art

Devices for stacking material have long been available in the prior art. For example, U.S. Pat. No. 25,524, issued in 1859, describes the concept of stacking printed sheets by means of a pivoted double conveyor wherein sheets entering into the printing press face down are piled face up in sequence.

U.S. Pat. No. 2,686,673 discloses apparatus for stacking flexible sheet material, such as hides or skins, into a pile, the apparatus having the capability of varying the form of stack provided. A pivoted double conveyor is also provided to deliver the sheet material to the pile. Electrical means are provided for detecting the leading and trailing edges of each sheet which in turn controls the movement of the double conveyor.

U.S. Pat. No. 2,250,572 discloses a machine for tearing material from a long web of material to form sheets and an oscillating pinch belt conveyor for delivering the torn sheets to a stack. The belt conveyor is caused to run faster than the speed at which the web is delivered through the tearing rolls so as to prevent slack in the material when it is engaged by the tearing roll.

U.S. Pat. No. 2,737,390 discloses an automatic hide or skin stacking device which includes means for delivering a workpiece on a workpiece receiving means and, in particular, wherein the discharge end of a pivoted double conveyor is arranged to oscillate in an arc over the work deposit zone such that a workpiece is draped over the receiving means. A circuit sensitive to the length of each workpiece is provided such that the center thereof is draped over the receiving means at the same position.

U.S. Pat. No. 2,743,924 discloses an improved control system for use in a machine of the type described in U.S. Pat. No. 2,737,390.

U.S. Pat. No. 2,766,045 discloses means for detecting the leading and trailing edges of a workpiece in a machine of the type described in U.S. Pat. No. 2,737,390 and further includes means intermediate the trailing and leading edge detector means to prevent false detection of intermediate edges of irregularly shaped workpieces.

U.S. Pat. No. 2,855,089 disclosed an apparatus for unloading a conveyor wherein a light source and photoelectric cell are used to detect the leading edge of a workpiece.

The aforementioned stacking apparatus involves various techniques for stacking printed sheets, skins or hides on a work receiving means at a work deposit zone. However, no means are described for limiting stack size or for automatically conveying the stack away from the deposit zone to allow the formation of additional stacks.

The inability of prior art stacking apparatus to automatically form a plurality of workpiece stacks makes their use in commercial laundries inefficient from a cost standpoint, since manual labor would still be required to continually remove and stack the laundry as it is formed. In particular, for commercial laundries, it would be desirable if a laundry piece stacking apparatus could be provided wherein pressed laundry pieces are stacked substantially smooth and wrinkle-free, with the edges of the stack aligned, with the alignment being maintained as the stack is conveyed towards a remote station after a predetermined number of laundry pieces have been placed in the stack and wherein additional stacks of predetermined size are continually being formed and similarly conveyed to the remote station.

SUMMARY OF THE INVENTION

In brief, arrangements in accordance with the present invention comprise a laundry piece stacking apparatus which stacks a predetermined number of laundry pieces uniformly and evenly in a stack. Laundry pieces of a predetermined size are conveyed from an ironing area along a double feed conveyor to a swing arm conveyor. The swing arm conveyor is pivotable and rotates in an arc above a work discharge zone. By appropriate adjusting means, the laundry pieces are evenly draped over a first conveyor means in a stacking arrangement until the number of pieces in the stack equals a predetermined count. At that time, the first conveyor means and a second, adjacent conveyor means are energized for a brief interval so that the first stack formed is transported away from the work deposit zone towards a workpiece receiving area located at the far end of the second conveyor means. The swing arm conveyor is inhibited from operation during this time period. After the stack is removed, additional stacks are formed on the first conveyor means and sequentially conveyed towards the receiving area. The number of stacks formed at one time on the first and second conveyor means is dependent upon the laundry piece size and the length of the first and second conveyor means. Means are provided for indicating the number of laundry pieces in the stack currently being formed and the total number of laundry pieces stacked.

BRIEF DESCRIPTION OF THE DRAWING

A better understanding of the present invention may be had from a consideration of the following detailed description, taken in conjunction with the accompanying drawing in which.

DESCRIPTION OF THE PREFERRED EMBODIMENT

Figure 1:
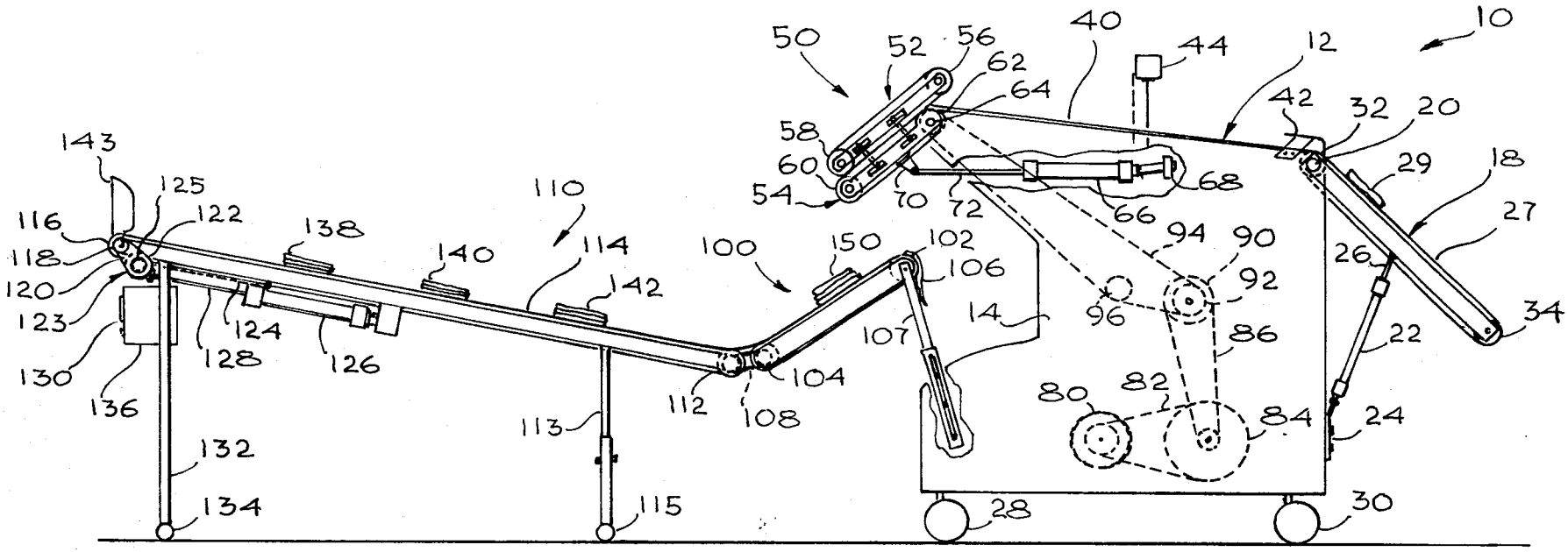
FIG. 1 is a simplified, side elevation view, with portions cut away, one particular arrangement of the present invention.

Referring now to FIG. 1, a simplified side elevation view of the stacking apparatus 10 of the present invention with portions cutaway is illustrated. In particular, apparatus 10 comprises a housing 12 having two side plates, only side plate 14 being shown. A pivotable, articulated conveyor 18 is mounted to the side plates via a pivoting pin 20. An air cylinder 22 is mounted, at one end, to housing 12 via adjustment bracket 24, and to conveyor 18, at the other end, by air cylinder yoke 26. Housing 12 is supported on casters 28 and 30 so that it can be moved to other locations as necessary. Conveyor 18 is positioned to receive laundry pieces from an ironer (not shown), apparatus 10 typically being installed in groups of five, mounted side by side in conjunction with a five lane wide ironer. As will be apparent from the description of the invention, the apparatus of the present invention eliminates the need for laborers who, in the prior art, took laundry pieces from the ironer and manually stacked them.

The conveyor belts 27 of conveyor 18 are mounted above drive roll 32 and idler roll 34, conveyor 18 being held in an appropriate position during operation of apparatus 10 by air cylinder actuator 22, conveyor 18 being dropped to a second position closer to housing 12 when the apparatus is not in operation. This feature is provided to accommodate the outward conveyor mechanism for the ironer (not shown) which drops down when not in use. Each laundry piece on conveyor 18 (one such laundry piece 29 is illustrated) is delivered to another conveyor system 40. A laundry deflector piece 42 is mounted adjacent the area where conveyor 18 transfers each laundry piece to conveyor 40 to ensure that the laundry piece transfers smoothly from one conveyor belt to the next. A scanning device 44, comprising a photoelectric cell and a lamp, is positioned adjacent conveyor 40 as shown to detect the leading and trailing edges of each laundry piece being conveyed. A laundry piece on conveyor 40 is conveyed to a pivotable swing arm conveyor 50 comprising upper swing arm 52 having a plurality of drive belts and lower swing arm 54, also having a plurality of drive belts, top roll 56 and bottom roll 58. The lower swing arm 54 comprises lower idler roll 60 and a specially machined drive roll 62 shown in more detail in FIG. 2. Lower swing arm 54 is pivotably coupled to housing 12 via pivot pin 64. An air cylinder 66 is mounted to housing 12 at one end via swing arm air cylinder mounting bracket 68 and mounted to a bracket 70 formed on the swing arm conveyor 50 by yoke member 72. A motor 80 has its output shaft coupled to drive belt 82 which drives drive member 84. A drive belt 86 is mounted on the output shaft of member 84 and to drive member 90 as shown. The output shaft 92 on member 90 has a drive belt 94 formed thereon which is looped around drive gear 62 and idler roll 96.

It should be noted that many of the details of the apparatus heretofore described, except the drive roll 62, are similar to the prior art systems such as the stacking apparatus described in U.S. Pat. No. 2,737,390. The teachings of the aforementioned patent necessary for a better understanding of the present invention are incorporated herein by reference.

Two additional conveyor belt systems 100 and 110 are provided in accordance with the teachings of the present invention. Conveyor 100 comprises a plurality of conveyor belts formed about conveyor idler roller 102 and conveyor drive roll 104. A laundry piece 106 is shown draped about a portion of the conveyor belt 102 as illustrated. A conveyor adjusting bracket 107 is provided to allow conveyor belt 100 to be adjusted to a predetermined angle such that the laundry piece 106 and each succeeding laundry piece which will form a stack can be properly draped over the end of the conveyor belt 100. Conveyor belt 100 is coupled to a second conveyor belt 110 by a drive belt chain 108 which couples conveyor drive roll 104 to conveyor idler roll 112. Sprockets are provided on both rolls 104 and 112 which enable the rolls to engage chain 108. Conveyor 110, shown supported at one end by adjustable leg member 113 and a caster 115, comprises drive belts 114 coupled at the far end to drive roll 116. Conveyor drive roll 116 has sprockets 118 formed at its central shaft and the sprockets 118 engage chain 120 (also see FIG. 3 for details of this conveyor drive arrangement). Chain 120 also engages sprockets 122 formed on the output shaft of clutch member 123. The clutch member 123 is driven by a sprocket wheel by means of a sprocket chain and spring 124, the far end of which is mounted to a bracket on the conveyor frame. Yoke 128 of air cylinder 126 is coupled to drive clutch member 123. A digital counter 130 is shown supported by leg member 132, the bottom of member 132 being mounted to caster 134. An electrical control box 136 is provided to control the operation of the apparatus 10. A plurality of laundry piece stacks 138, 140, 142 are shown as being formed on conveyor 110 in the process of being moved to the output work station. A backstop 143 to stop the formed stacks at the end of conveyor system 110 is provided.

In operation, after traversing conveyors 18 and 40, laundry pieces pass to the swing arm conveyor 50. As set forth hereinabove, swing arm conveyor 50 is pivoted at point 64 and is moved through an arc at a particular point in time by air cylinder actuator 66 in order to drape laundry pieces over the end of conveyor belt 100 positioned beneath the swing arm conveyor 50, laundry piece 102 being shown in the draped position and comprising the first piece in a stack being formed. Counter 130 is set at a predetermined number of pieces to be formed for each stack. When a stack reaches that number of pieces, conveyors 100 and 110 are actuated for a brief interval of time sufficient to permit the formed stack to advance out of the stacking range of swing arm 50 so that the next sequential stack can be formed (stack 150 illustrates the immediately previous stack formed). Another totalizer counter (not shown) is provided to maintain the total number of pieces processed through the apparatus. The scanning device 44 allows the detection of both the leading edge and the trailing edge of a laundry piece being processed and thus (with the circuitry described with reference to FIG. 4) enables the length of the laundry piece to be stacked to be determined. The signals provided by scanner 44 are fed into control box 136 which provides a 110 volt power pulse to a four-way valve solenoid (not shown) which controls the air cylinder actuator 66 associated with the swing arm 50. It should be noted that there is a transit time delay for the laundry piece to pass into swing arm 50 after the laundry piece has activated the scanner 44. The purpose of measuring the length of the laundry piece and actuating the swing arm 50 in response thereto is so that the laundry piece will be draped on the stack formed on conveyor 100 to extend substantially equally in both directions measured from a reference line formed on the uppermost end of the conveyor 100.

Conveyors 100 and 110 are mounted on separate conveyor apparatus and are interconnected by sprockets and chain 108 which is actuated by air cylinder 126 when the predetermined number of laundry pieces are in the stack being formed. This drives the conveyor rolls by means of a ratcheting clutch member 123. In this manner, the reciprocating motion of the air cylinder yoke 128 is converted to one-way rotary motion in the conveyors 100 and 110.

Figure 2:
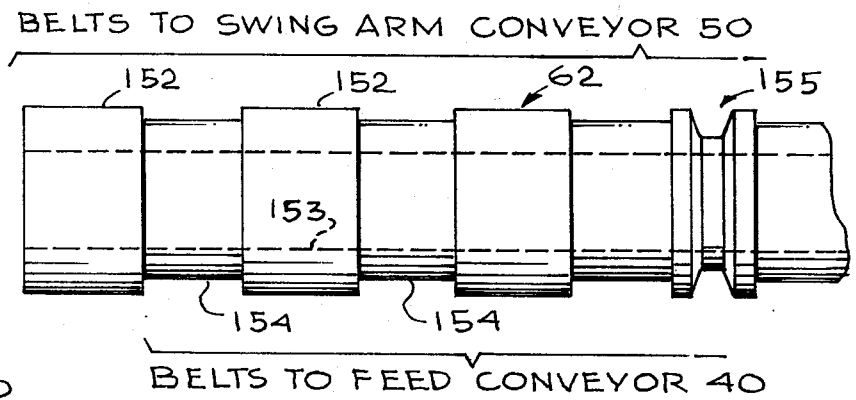
FIG. 2 is an elevational view of a drive roll utilized in the apparatus of FIG. 1.

A slight change of speed in the conveyors driving the laundry piece at the point of transition between conveyor 40 and swing arm conveyor 50 is effected by having a single drive roller 62 milled to develop different sections of different radii along the extent of the roller as shown in FIG. 2 (typical length of 17.5 inch overall and having a 1.375 inch inside diameter steel tubing 153). The more extended portions 152 of the roll 62 (typical outside diameter of 2.375 inch) drive individual belts of the swing arm conveyor 50 and the smaller sections 154 (typical outside diameter of 2.125 inch) have individual belts on conveyor 40 mounted thereabout (the right-hand portion of the roller 62 has been omitted for simplicity). At the center of the drive roller 62 is a drive pulley 155 formed as an integral part of the roller 62. The drive belt 94 (FIG. 1), typically a V-belt or the like, engages the pulley 155 to drive the conveyor belt drive roller 62. Thus as the laundry piece enters the swing arm conveyor 50 it is pulled forward from the conveyor 40 because of the slightly greater peripheral speed of the conveyor 50. This helps to straighten and smooth out the laundry piece. As will be set forth hereinafter with reference to FIG. 4, a potentiometer is provided which can adapt the apparatus for handling laundry pieces of various sizes such as for example, handling napkins of either an 18×18 inch or 24×24 inch size or pillow cases of 24×36 inches. For a single size of laundry pieces, the potentimeter is adjusted to an appropriate setting and then left alone. This setting is used to bring the time delay within the range of control of the scanner 44 such that each laundry piece is properly draped over conveyor 100 as shown.

Figure 3:
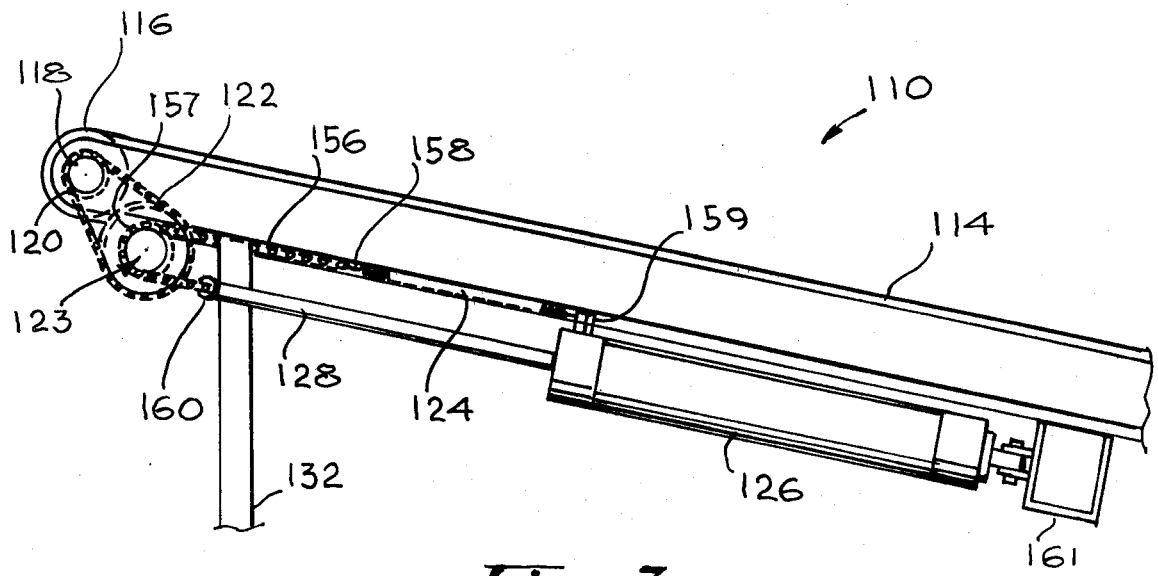
FIG. 3 is a detailed view of the drive mechanism for the stack removing conveyors shown in FIG. 1.

FIG. 3 illustrates, in greater detail, the operation of the intermittent drive mechanism for conveyors 100 and 110. In particular, the drive roller 116 over which the individual belts 114 making up the conveyor 110 are mounted has a sprocket wheel 118 mounted on its central shaft. This sprocket wheel 118 engages a sprocket chain 120 extending to a drive sprocket 122 on a clutch mechanism 123. A drive sprocket 157 for the clutch 123 engages a sprocket chain 156. One end of the chain 156 is coupled to the actuating rod 128 of the air cylinder 126 at a coupling 160. The other end of the chain is connected to a spring 124 at a link 158. Spring 124 is secured to the frame of the conveyor at a bracket 159.

When the number of pieces in the stack at the end of the conveyor 100 (see FIG. 1) reaches a predetermined count, a signal generated by the stack counter energizes a solenoid valve which applies air from the pneumatic system to the air cylinder 126. This retracts the actuator arm 128, pulling the chain 156 around the sprocket wheel 157 against the tension force of the spring 124. This serves to drive the clutch 123 in a counterclockwise direction, thus causing the drive roller 116 to advance the belts 114 from right to left on the upper side of conveyor 110. When the momentary fluctuation of air cylinder 126 is terminated, the spring 124 retracts the chain 156, thus causing the actuator arm 128 to extend to the position shown in FIG. 3 in preparation for another actuation of the drive system for the belts 114. The clutch 123 is a one-way, or ratcheting, clutch which drives the chain 120 in only one direction—namely the direction of advancing the belts 114 from right to left. This driving arrangement for the conveyor 110 is effective to advance a completed stack of laundry items, such as the stack 150 (FIG. 1), out of the position where the next stack is to be formed, the stack 150 being moved just enough to clear the position of the next stack. Thus, a number of stacks may be situated along the conveyors 100, 110 while the stacking apparatus is being operated. This incremental advancement of the stack conveyors is accomplished by the mechanism shown in FIG. 3 without the need for any more complicated motor drive arrangement.

Figure 4:
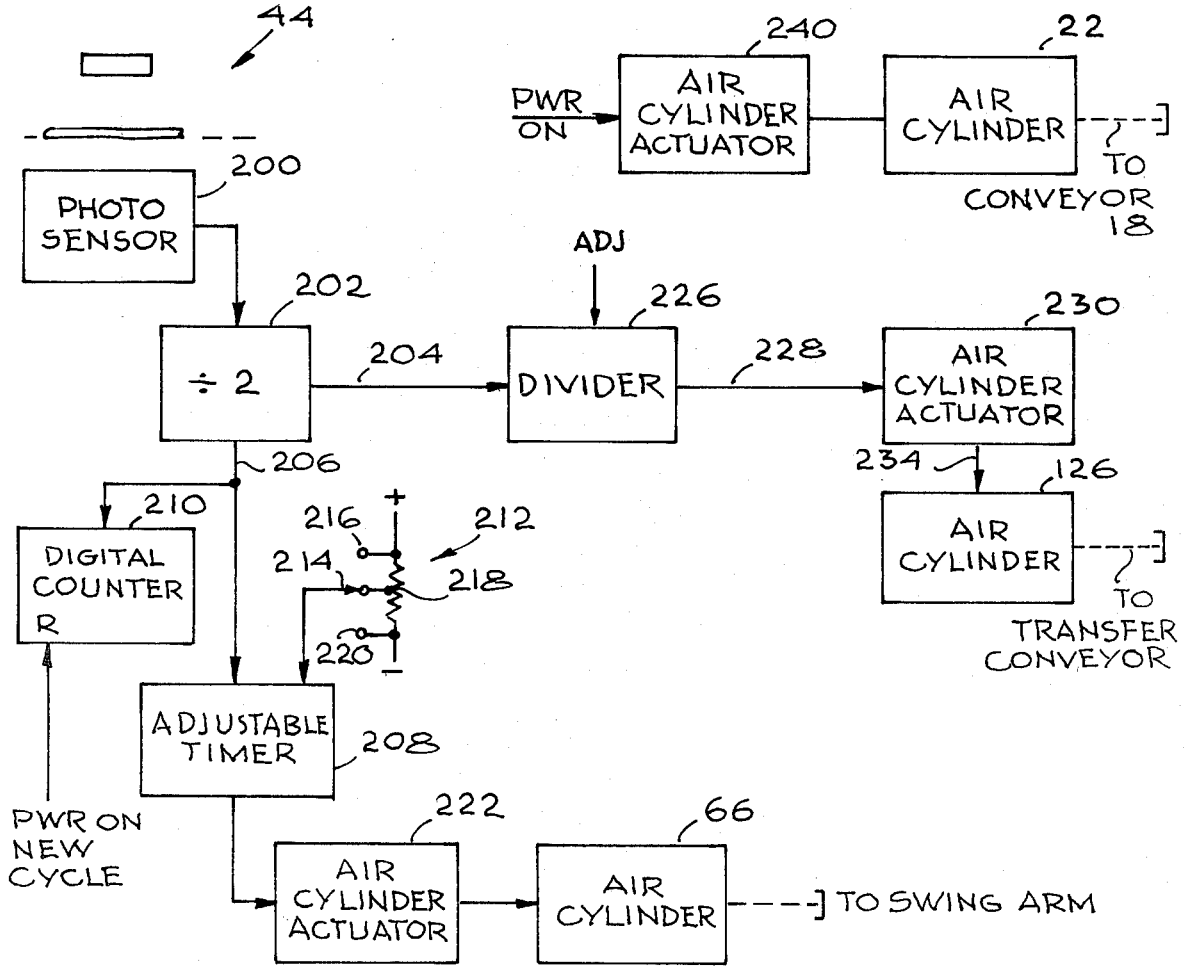
FIG. 4 is a block diagram of the control system for the stacking apparatus of FIG. 1.

FIG. 4 is a simplified block diagram of the electrical control system of the present invention. The output of photosensor 200 of scanner 44 is supplied to a counter 202 which, in the embodiment shown, is a divide-by-two counter. In other words, counter 202 only provides an output on leads 204 and 206 for every two pulses generated by the photosensor 200. Thus, since each laundry piece would generate two pulses due to the detection of both its leading and trailing edges, the output of counter 202 represents the transition of one laundry piece along conveyor system 40. The output on lead 206 is coupled to an adjustable timer 208 and digital counter 210. The output from a potentiometer 212, having an adjustable tap 214, is supplied to a second input of adjustable timer 208. For illustrative purposes only, adjustable potentiometer 212 is shown to have three output taps 216, 218 and 220 which correspond to the three sizes of laundry pieces being stacked. Potentiometer 212 may have additional tap settings if desired, corresponding to other piece sizes. This control on the timer 208 compensates for different lengths of the laundry being transported to the swing arm 50 and also assures that at least one edge of each stacked laundry piece is aligned when draped on conveyor system 100. The output of adjustable timer 208 is coupled to air cylinder actuator, or solenoid 222. Actuator 222 acts on air cylinder 66 which in turn controls the pivotable movement of swing arm conveyor 50. The output of divider 202 is applied via lead 204 to a divider 226, the output count of which is adjustable. Divider 226 is set to provide an output signal when a desired number of laundry pieces are formed on a single stack. When this occurs, divider 226 generates an output on lead 228 which is coupled to air cylinder actuator or solenoid, 230. The output of actuator 230 is applied to air cylinder 126 via lead 234, air cylinder 126 controlling the motion of conveyors 100 and 110 as described hereinabove in reference to FIG. 1.

The output of counter 210 provides a visible indication of the total number of laundry pieces stacked during a particular cycle of system operation. For example, a count can be provided which indicates the number of laundry pieces stacked for a particular day. A reset signal is applied to the reset terminal R of counter 210 when system power is applied (button or switch closed in standard manner) or when a new stacking cycle is initiated.

Conveyor 18 is moved to its operating position as shown in FIG. 1 by coupling the power-on signal to air cylinder actuator, or solenoid, 240 which then activates air cylinder 22. Removal of the power-on signal will cause conveyor 18 to return to its rest position.

Figure 5:
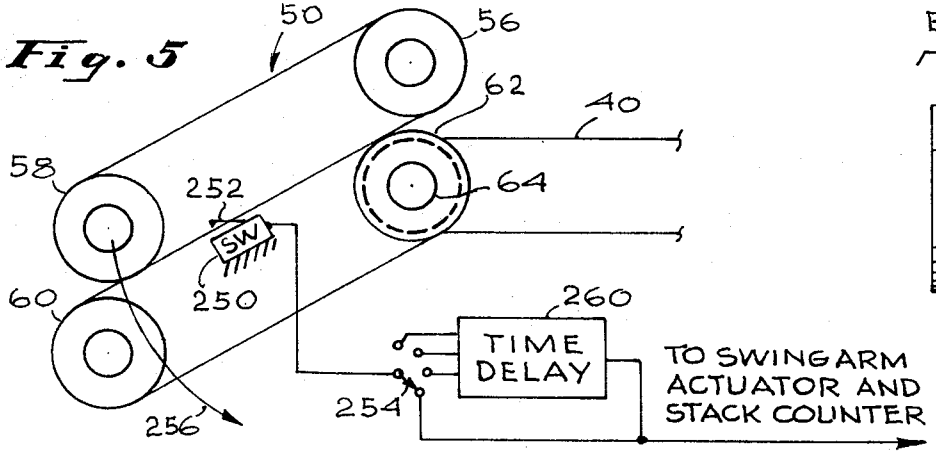
FIG. 5 is a schematic view of a portion of the apparatus of FIG. 1, showing details of an alternative embodiment.

FIG. 5 represents in schematic form an alternate arrangement in accordance with the invention for detecting a laundry piece and initiating the movement of the swing arm conveyor to deposit the piece on the stack. FIG. 5 shows the swing arm conveyor 50 comprising two sets of conveyor belts extending about the rollers 56, 58 and 60, 62 respectively and mounted for pivoting about the pivot point 64 as described in conjunction with FIG. 1. The swing arm actuator has been omitted from FIG. 5 for simplicity, but details of its mounting and operation can be found in FIG. 1 and in the related description.

The alternative arrangement of FIG. 5 incorporates a Microswitch 250 having an actuating lever 252 projecting through a space between belts of the swing conveyor 50 to detect the movement of a laundry piece through the swing arm conveyor. The switch 250 is mounted to the frame of the swing arm conveyor. A signal from the switch 250 is coupled to a selector switch 254 having contacts connected to a time delay stage 260. The output of the time delay stage 260 and one of the contacts of the switch 254 are tied together to a line directed to the swing arm actuator and the stack counter, as shown and described more particularly in FIGS. 1 and 4. This circuit is designed to provide a signal upon the release of the switch arm 252 which occurs as the trailing edge of the laundry piece passes the location of the arm 252. The change of state of switch 250 which occurs when the switch arm 252 is released results in a signal being applied as an actuating signal directed to the swing arm actuator and stack counter for the longest pieces to be stacked by the apparatus, this actuating signal is applied directly to the swing arm actuator. For shorter pieces of varying lengths, the switch 254 is set to one of the varying time delay intervals of stage 260, to provide an appropriate time delay before the swing arm conveyor is actuator is energized, thus resulting in the workpiece being deposited in centered alignment on the end of the stack conveyor. This arrangement shown in FIG. 5 replaces the photosensor 44 and related electrical counting circuitry, pulse dividers, etc. of FIGS. 1 and 4. Actuation of the swing arm actuator causes the swing arm conveyor 50 to move in the direction of the arrow 256, thus draping the laundry piece on the stack. As an alternative to the time delay stage 260, or in addition thereto, the physical position of the switch 250 may be adjusted to a particular point along the frame on which it is mounted to determine the desired point at which actuation of the swing arm conveyor 50 in the direction of the arrow 256 is initiated, in accordance with the position of the trailing edge of the laundry piece.

Although there have been described above specific arrangements of a laundry stacking apparatus in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. Stacking apparatus for workpieces comprising:

a main frame;

a delivery arm pivotably connected thereto;

a piece conveyor system adapted to convey said pieces along said frame to said delivery arm, said delivery arm comprising a double conveyor for transporting and discharging said pieces to form a stack;

actuating means for oscillating said arm first in one direction and then in the other through a predetermined angle of oscillation;

detector means in said conveyor system responsive to the passage of a workpiece;

control means operative in response to said detector means for controlling said actuating means;

means for forming a stack of a predetermined number of said workpieces in a work deposit zone;

counter means for providing an indication of the number of workpieces in said stack; and a stack conveyor system comprising:

a first conveyor, having an upper surface portion, mounted at a selected orientation to develop a rounded surface for the deposit of the pieces thereon in a generally centered alignment with the upper portion of said surface;

a second conveyor coupled to said first conveyor in common driving relationship; and means for intermittently advancing both of said first and second conveyors when the stack of deposited pieces reaches a predetermined count to remove the stack from the work deposit zone, the intermittently advancing means comprising a one-way clutch coupled to a drive roller of one of the first and second conveyors and a reciprocating actuator coupled to the one-way clutch by a drive chain.

2. The apparatus of claim 1 wherein said material workpieces comprise laundry pieces.

3. The apparatus of claim 1 further including a rotary coupling means mounted on said clutch and having the drive chain extending thereover, the drive chain being connected to the reciprocating actuating means at one end and being coupled at the other end to tensioned retracting means.

4. The apparatus of claim 3 wherein the tension retracting means comprises a spring coupled between the other end of the chain and a frame mounting member, the retracting means being effective to restore the reciprocating actuator to a released position at the end of a cycle of actuation for advancing the stack conveyor system.

5. The apparatus of claim 1 wherein a second stack of a predetermined count is formed at the work deposit zone on said first conveyor after the previous stack is removed from said work deposit zone.

6. The apparatus of claim 1 wherein the piece conveyor system and one of said conveyors in said delivery arm are driven by a common drive roller.

7. The apparatus of claim 6 wherein the common drive roller comprises a plurality of sections of differing radius along the extent thereof for driving the piece conveyor and the delivery arm conveyor at different speeds.

8. The apparatus of claim 7 wherein the piece conveyor and the delivery arm conveyor each comprise a plurality of individual, spatially separated belts, the belts of the delivery arm conveyor extending over the roller sections of larger radius to develop greater belt speed than the conveyor system belts, whereby the workpieces are accelerated as they transfer from the piece conveyor system to the delivery arm conveyor in a manner to smooth the work pieces.

9. The apparatus of claim 1 wherein the detector means comprises a photocell selectively positioned along the piece conveyor system for detecting at least one edge of a workpiece and providing a count signal, and further including means for applying the count signal to the counter means and to the control means for energizing the actuating means.

10. The apparatus of claim 9 wherein said detector means detects both the leading and trailing edges of a workpiece, and further including means for dividing signals from the detector means by two in order to develop the count signal.

11. The apparatus of claim 1 wherein the detector means comprises a switch selectively positioned along the delivery arm conveyor, said switch developing said count signal at the passage of the trailing edge of the workpiece past the switch.

12. The apparatus of claim 11 further including time delay means for selectively delaying the actuation of the delivery arm by a selected interval correlated with the length of the workpieces in order to have them deposited in generally centered alignment in the work deposit zone.

* * * * *